US009889658B2

(12) United States Patent
Noguchi

(10) Patent No.: US 9,889,658 B2
(45) Date of Patent: Feb. 13, 2018

(54) BONDED MEMBER, LIQUID DISCHARGE HEAD, LIQUID DISCHARGE DEVICE, AND LIQUID DISCHARGE APPARATUS

(71) Applicant: Takuya Noguchi, Kanagawa (JP)

(72) Inventor: Takuya Noguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/266,058

(22) Filed: Sep. 15, 2016

(65) Prior Publication Data

US 2017/0106649 A1 Apr. 20, 2017

(30) Foreign Application Priority Data

Oct. 16, 2015 (JP) ..... 2015-204243

(51) Int. Cl.
*B41J 2/14* (2006.01)

(52) U.S. Cl.
CPC ..... *B41J 2/1433* (2013.01)

(58) Field of Classification Search
CPC ..... B41J 2/1623; B41J 2/14233; B41J 2/161; B41J 2/14209; B41J 2002/14217; B41J 2002/14306; B41J 2/1433; B41J 2/14201; B41J 2/04581
USPC ..... 347/20, 40, 44, 47, 54, 68, 70–72
See application file for complete search history.

(56) References Cited

U.S. PATENT DOCUMENTS

2003/0063137 A1* 4/2003 Kamei ..... B41J 2/1623 346/70
2004/0246292 A1 12/2004 Hashimoto et al.

FOREIGN PATENT DOCUMENTS

| | | |
|---|---|---|
| JP | 2001-047620 | 2/2001 |
| JP | 2004-050716 | 2/2004 |
| JP | 2006-076128 | 6/2006 |
| JP | 2006-173428 | 6/2006 |
| JP | 2009-283753 | 12/2009 |
| JP | 2011-213036 | 10/2011 |

* cited by examiner

*Primary Examiner* — Jannelle M Lebron
(74) *Attorney, Agent, or Firm* — Cooper & Dunham LLP

(57) ABSTRACT

A bonded member includes at least two members. The at least two members include a first member and a second member bonded to each other. The first member has a bonded face bonded to the second member. The bonded face has a recessed portion at an outer periphery of the bonded face, to retain an adhesive. The recessed portion is open at the bonded face and an outer peripheral face of the first member. In a plan view from a direction vertical to the bonded face, an outer edge of a bottom face of the recessed portion is disposed at an inner position in an in-plane direction of the bonded face than an outer edge of the outer peripheral face of the first member.

16 Claims, 15 Drawing Sheets

BONDED MEMBER, LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2015-204243 filed on Oct. 16, 2015 in the Japan Patent Office, the entire disclosure of which is hereby incorporated by reference herein.

BACKGROUND

Technical Field

Aspects of the present disclosure relate to a bonded member, a liquid discharge head including the bonded member, a liquid discharge device including the liquid discharge head, and a liquid discharge apparatus including the liquid discharge device.

Related Art

For example, a liquid discharge head includes head component members, such as a nozzle plate, a channel plate, a wall member, a holding substrate, and a common-liquid-chamber substrate, which are bonded with each other with an adhesive.

SUMMARY

In an aspect of the present disclosure, there is provided a bonded member that includes at least two members. The at least two members include a first member and a second member bonded to each other. The first member has a bonded face bonded to the second member. The bonded face has a recessed portion at an outer periphery of the bonded face, to retain an adhesive. The recessed portion is open at the bonded face and an outer peripheral face of the first member. In a plan view from a direction vertical to the bonded face, an outer edge of a bottom face of the recessed portion is disposed at an inner position in an in-plane direction of the bonded face than an outer edge of the outer peripheral face of the first member.

In another aspect of the present disclosure, there is provided a liquid discharge head that includes the bonded member.

In still another aspect of the present disclosure, there is provided a liquid discharge device that includes the liquid discharge head.

In still yet another aspect of the present disclosure, there is provided a liquid discharge apparatus that includes the liquid discharge device.

In still yet another aspect of the present disclosure, there is provided a liquid discharge apparatus that includes the liquid discharge head.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
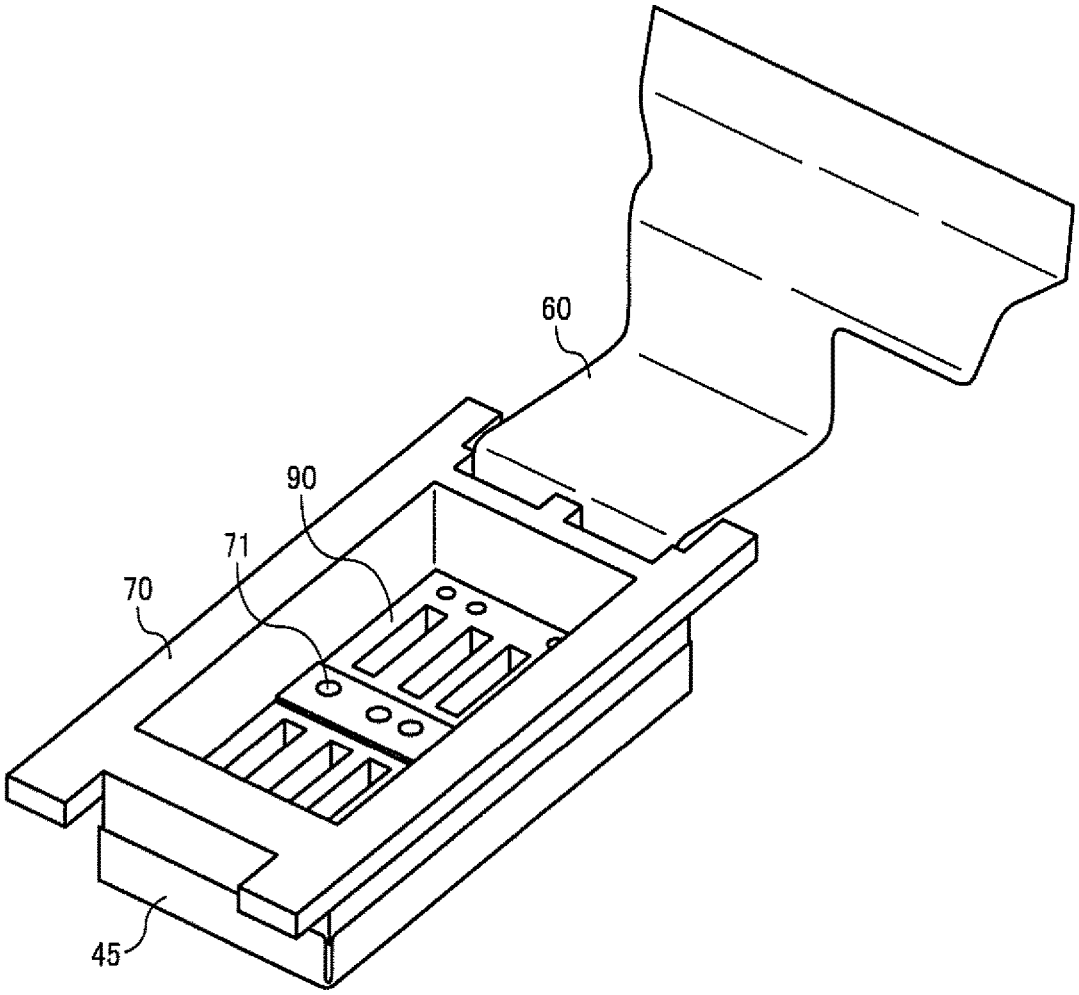
FIG. 1 is a perspective view of an example of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, wherein like reference numerals designate identical or corresponding parts throughout the several views, exemplary embodiments of the present disclosure are described below.

Figure 2:
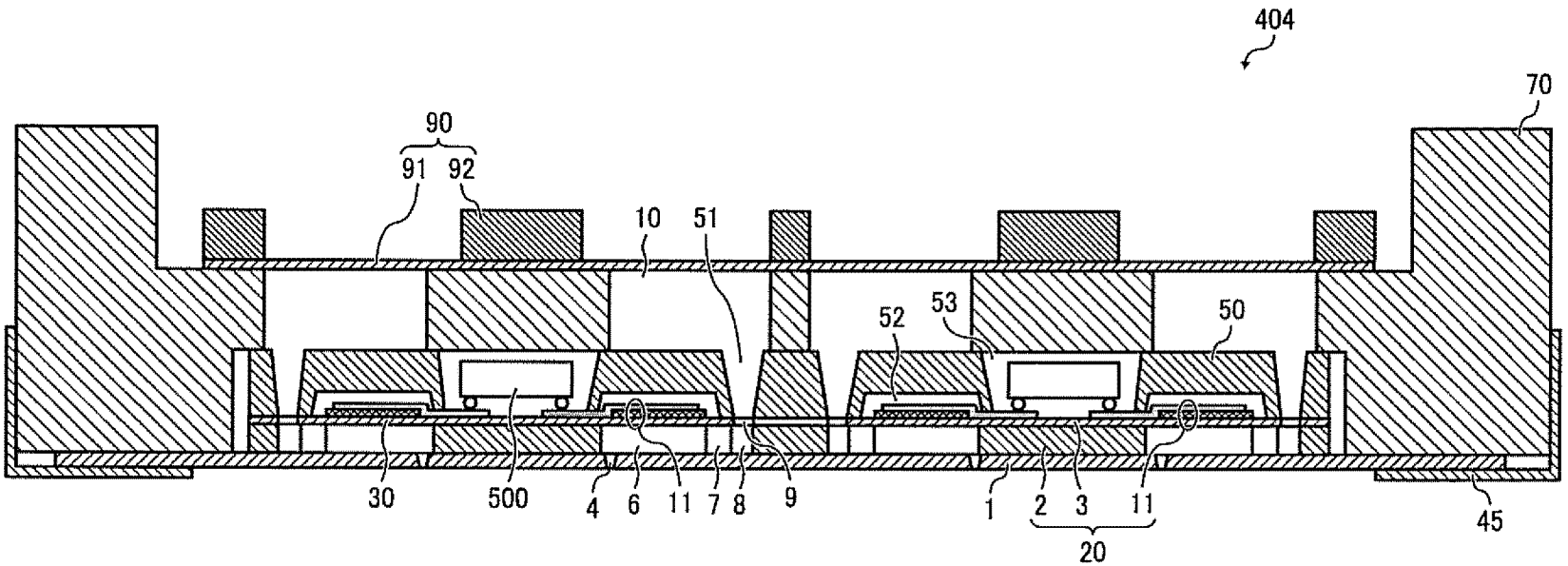
FIG. 2 is a cross-sectional view of a portion of the liquid discharge head of FIG. 1 cut along a direction perpendicular to a nozzle array direction in which nozzles are arrayed in row.
Figure 3:
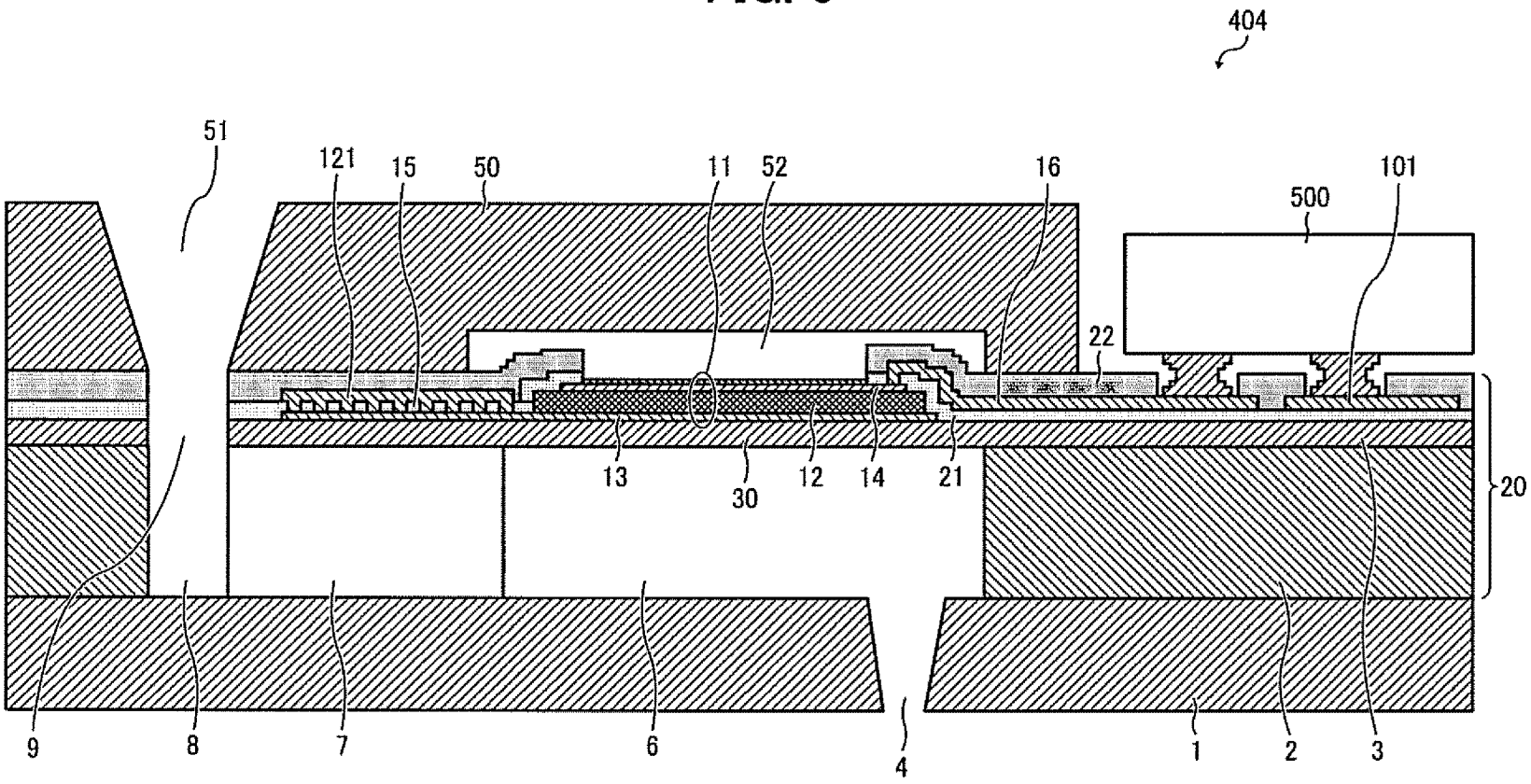
FIG. 3 is an enlarged cross-sectional view of a portion of the liquid discharge head of FIG. 2.
Figure 4:
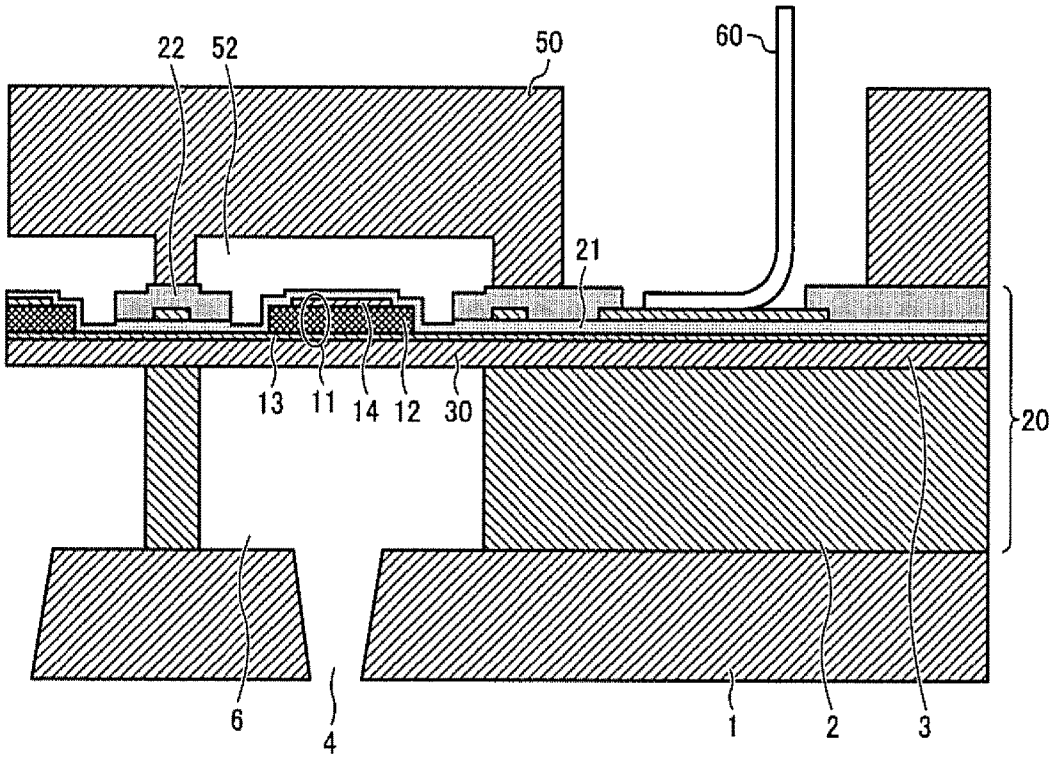
FIG. 4 is a cross-sectional view of a portion of the liquid discharge head of FIG. 2 cut along the nozzle array direction.

A liquid discharge head according to an embodiment of the present disclosure is described with reference to FIGS. 1 to 4. FIG. 1 is an exploded perspective view of the liquid discharge head according to an embodiment of the present disclosure. FIG. 2 is a cross-sectional view of the liquid discharge head cut of FIG. 1 along a direction perpendicular to a nozzle array direction in which nozzles are arrayed in row. FIG. 3 is an enlarged cross-sectional view of a portion of the liquid discharge head of FIG. 2. FIG. 4 is a cross-sectional view of a portion of the liquid discharge head of FIG. 2 cut along the nozzle array direction.

A liquid discharge head 404 according to the present embodiment includes a nozzle plate 1, a channel plate 2, a diaphragm plate 3 as a wall member, piezoelectric elements 11 as pressure generating elements (pressure generators), a holding substrate 50, a wire 60, and a frame substrate 70 also serving as a common-liquid-chamber substrate.

The channel plate 2, the diaphragm plate 3, and the piezoelectric element 11 form an actuator substrate 20 according to the present embodiment. Note that the actuator substrate 20 does not include the nozzle plate 1 or the holding substrate 50 that is bonded to the actuator substrate 20 after the actuator substrate 20 is formed as an independent component. The channel plate 2 and the diaphragm plate 3 form a channel substrate.

The nozzle plate 1 includes a plurality of nozzles 4 to discharge liquid. In the present embodiment, the nozzles 4 are arrayed in four rows.

With the nozzle plate 1 and the diaphragm plate 3, the channel plate 2 forms individual liquid chambers 6 communicated with the nozzles 4, fluid restrictors 7 communicated with the individual liquid chambers 6, and liquid inlets (passages) 8 communicated with the fluid restrictors 7.

The liquid inlets 8 are communicated with the common liquid chambers 10 in the frame substrate 70 via passages (supply ports) 9 of the diaphragm plate 3 and openings 51 as channels of the holding substrate 50.

The diaphragm plate 3 includes deformable vibration portions 30 forming part of walls of the individual liquid chambers 6. The piezoelectric element 11 is disposed integrally with the vibration portion 30 on a face of the vibration portion 30 opposite the individual liquid chamber 6. The vibration portion 30 and the piezoelectric element 11 form a piezoelectric actuator.

In the piezoelectric element 11, a lower electrode 13, a piezoelectric layer (piezoelectric body) 12, and an upper electrode 14 are laminated in this order from the vibration portion 30. An insulation film 21 is disposed on the piezoelectric element 11.

The lower electrode 13 as a common electrode for the plurality of piezoelectric elements 11 is connected to a common-electrode power-supply wiring pattern 121 via a common wire 15. Note that, as illustrated in FIG. 4, the lower electrode 13 is a single electrode layer straddling all of the piezoelectric elements 11 in the nozzle array direction.

The upper electrodes 14 as discrete electrodes for the piezoelectric elements 11 are connected to a drive integrated circuit (IC) 500 (hereinafter, driver IC 500) as a drive circuit via individual wires 16. The individual wire 16 is covered with an insulation film 22.

The driver IC 500 are mounted on the actuator substrate 20 by, e.g., a flip-chip bonding method, to cover an area between rows of the piezoelectric elements 11.

The driver IC 500 mounted on the actuator substrate 20 is connected to a discrete-electrode power-supply wiring pattern 101 to which a drive waveform (drive signal) is supplied.

One end of the wire 60 is electrically connected to the driver IC 500. The opposite end of the wire 60 is connected to a controller mounted to an apparatus body.

The openings 51 as channels communicating the common liquid chambers 10 with the individual liquid chambers 6 as described above, recessed portions 52 to accommodate the piezoelectric elements 11, and the holding substrate 50 including openings 53 to accommodate the driver ICs 500 are disposed on the actuator substrates 20.

The holding substrate 50 is bonded to a side of the actuator substrate 20 facing the diaphragm plate 3 with adhesive.

The frame substrate 70 includes the common liquid chambers 10 to supply liquid to the individual liquid chambers 6. Note that, in the present embodiment, the four common liquid chambers 10 are disposed corresponding to the four nozzle rows. Desired colors of liquids are supplied to the respective common liquid chambers 10 via liquid supply ports 71 (see FIG. 1).

A damper unit 90 is bonded to the frame substrate 70. The damper unit 90 includes a damper 91 and damper plates 92. The damper 91 is deformable and forms part of walls of the common liquid chambers 10. The damper plates 92 reinforce the damper 91.

The frame substrate 70 is bonded to an outer peripheral portion of the nozzle plate 1, to accommodate the actuator substrate 20 and the holding substrate 50, thus forming a frame of the liquid discharge heads 404.

Nozzle covers 45 are disposed to cover part of a peripheral area of the nozzle plate 1 and part of outer circumferential faces of the frame substrate 70.

In the liquid discharge head 404, voltage is applied from the driver IC 500 to a portion between the upper electrode 14 and the lower electrode 13 of the piezoelectric element 11. Accordingly, the piezoelectric layer 12 expands in an electrode lamination direction (in other words, an electric-field direction) in which the upper electrode 14 and the lower electrode 13 are laminated, and contracts in a direction parallel to the vibration portion 30.

At this time, since a side (hereinafter, lower electrode 13 side) of the piezoelectric layer 12 facing the vibration portion 30 is bound by the vibration portion 30, a tensile stress arises at the lower electrode 13 side of the vibration portion 30, thus causing the vibration portion 30 to bend toward a side (hereinafter, individual liquid chamber 6 side) of the vibration portion 30 facing the individual liquid chamber 6. Accordingly, liquid within the individual liquid chamber 6 is pressurized and discharged from the nozzle 4.

Next, a first embodiment of the present disclosure is described with reference to FIGS. 5 through 11.

In bonding two members with an adhesive, to enhance the accuracy of positioning bonded members, for example, the two members are temporarily bonded together with a temporary bonding adhesive to position the two members, and then a final bonding adhesive is cured to finally bond the two members.

In such a case, the temporary bonding adhesive is retained on one of the two members. For example, when a light irradiation adhesive, such as an ultraviolet curing adhesive, is used as the temporary bonding adhesive, a portion retaining the temporary bonding adhesive is preferably open at an outer peripheral face of the member.

However, when the portion retaining the temporary bonding adhesive is disposed at an outer periphery of the member and is open at the outer peripheral face, the temporary bonding adhesive is likely to extend off to the outer peripheral face of the member.

Hence, as described below, according to at least one embodiment of the present disclosure, such extension of adhesive to the outer peripheral face of the member can be reduced.

Figure 5:
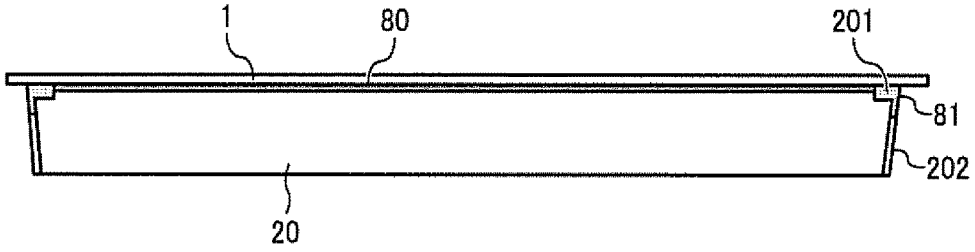
FIG. 5 is a side view of a bonded member in which a nozzle plate and an actuator substrate are bonded together in a first embodiment of the present disclosure.
Figure 6:
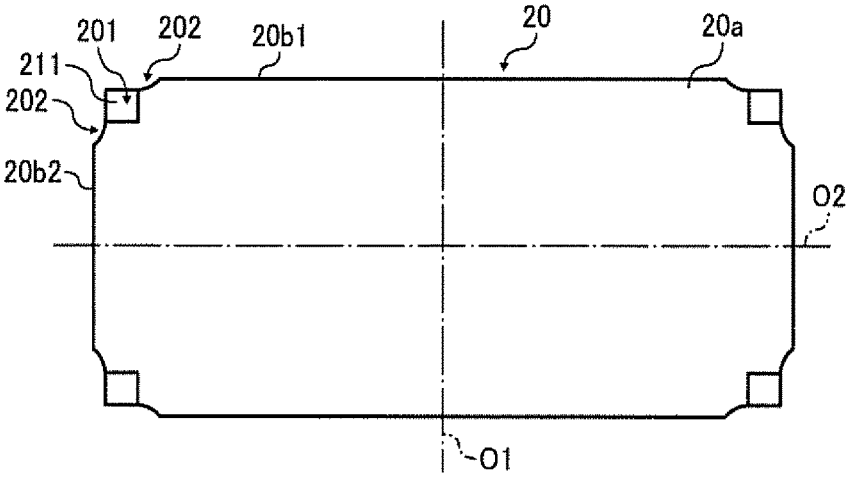
FIG. 6 is a plan view of a bonded face side of the actuator substrate to be bonded to the nozzle plate in the first embodiment.
Figure 7:
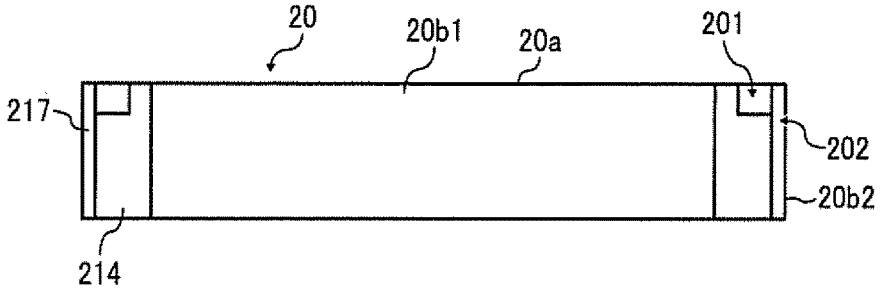
FIG. 7 is a side view of a long side of the actuator substrate in the first embodiment.
Figure 8:
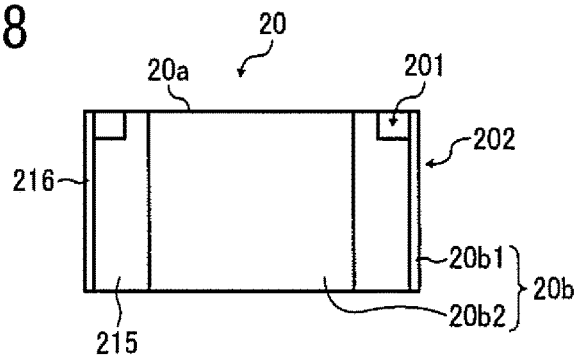
FIG. 8 is a side view of a short side of the actuator substrate in the first embodiment.
Figure 9:
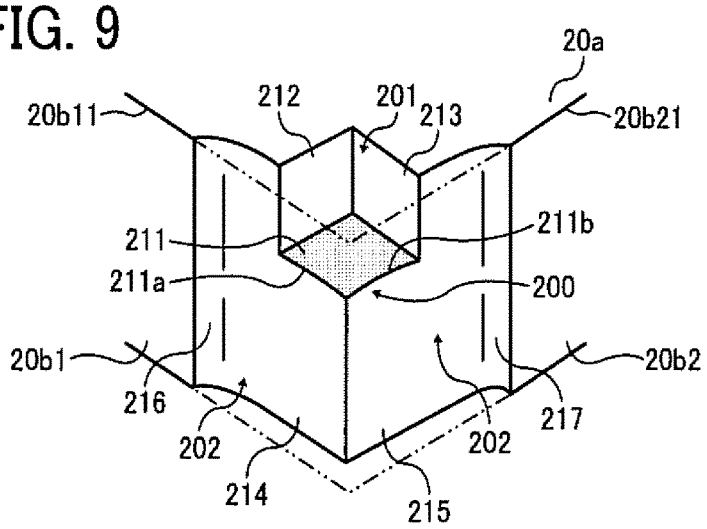
FIG. 9 is an enlarged perspective view of an area around a step portion of the actuator substrate in the first embodiment.
Figure 10:
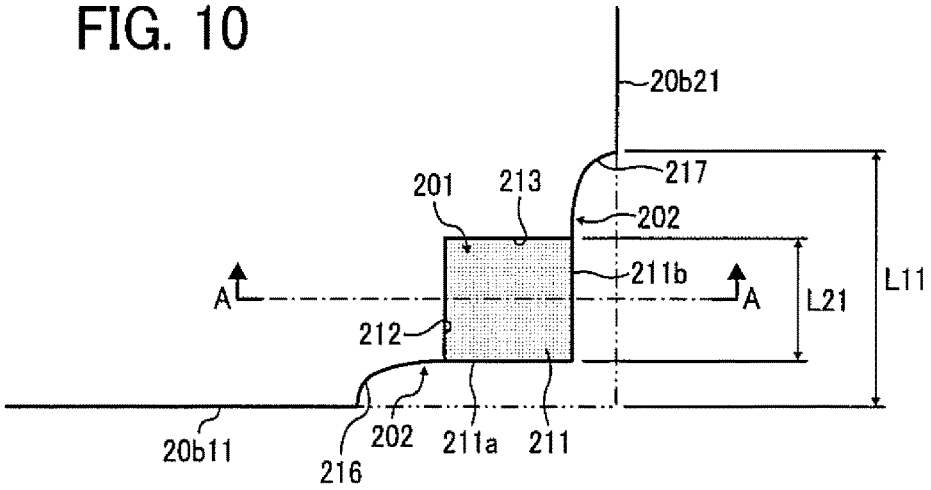
FIG. 10 is a cross-sectional view of the area around the step portion of the actuator substrate in the first embodiment.
Figure 11:
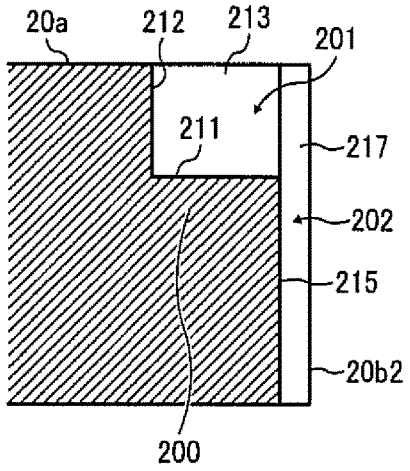
FIG. 11 is a cross-sectional view of the area around the step portion of the actuator substrate, cut along line A-A of FIG. 10.

FIG. 5 is a side view of the bonded member in which the nozzle plate and the actuator substrate are bonded together in the first embodiment of the present disclosure. FIG. 6 is a plan view of a bonded face side of the actuator substrate to be bonded to the nozzle plate. FIG. 7 is a side view of a long side of the actuator substrate. FIG. 8 is a side view of a short side of the actuator substrate. FIG. 9 is an enlarged perspective view of an area around a step portion of the actuator substrate. FIG. 10 is a cross-sectional view of the area around the step portion of the actuator substrate. FIG. 11 is a cross-sectional view of the area around the step portion of the actuator substrate, cut along line A-A of FIG. 10.

In the first embodiment, the nozzle plate 1 is bonded to the actuator substrate 20 including the channel plate 2 with adhesive 80 to form the bonded member. The actuator substrate 20 is one member of the bonded member according to the present embodiment and the nozzle plate 1 is the other member of the bonded member.

Here, a face of the actuator substrate 20 to be bonded to the nozzle plate 1 is referred to as a bonded face 20*a*. Of side walls at an outer periphery of the actuator substrate 20 crossing the bonded face 20*a*, side walls extending in the long direction of the actuator substrate 20 are referred to as outer peripheral faces 20*b*1, and side walls extending in the short direction are referred to as outer peripheral faces 20*b*2. The outer peripheral faces 20*b*1 and the outer peripheral faces 20*b*2 are collectively referred to as outer peripheral faces 20*b* unless distinguished.

The actuator substrate 20 is rectangular in a plan view seen from a direction vertical to the bonded face 20*a*.

The actuator substrate 20 includes recessed portions 201 at four corners of the outer periphery of the bonded face 20*a*. Each recessed portion 201 is open in three directions to the bonded face 20*a* side, the outer peripheral face 20*b* side, and the outer peripheral face 20*b* side. The recessed portions 201 retain the adhesive 81. The recessed portions 201 are disposed at line-symmetric positions with respect to a center line O1 and a center line O2 of the bonded face 20*a*.

In the plan view seen from the direction vertical to the bonded face 20*a*, an outer edge 211*a* and an outer edge 211*b* of a bottom face 211 of the recessed portion 201 (see also FIG. 9) are located at inner positions in an in-plane direction of the bonded face 20*a* than an outer edge 20*b*11 of the outer peripheral face 20*b*1 and an outer edge 20*b*21 of the outer peripheral face 20*b*2.

In the present embodiment, each of the outer peripheral face 20*b*1 and the outer peripheral face 20*b*2 has a cutout portion 202. Accordingly, the outer edge 211*a* and the outer edge 211*b* of the bottom face 211 of each recessed portion 201 is receded more inwardly in the in-plane direction of the bonded face 20*a* than the outer edge 20*b*11 of the outer peripheral face 20*b*1 and the outer edge 20*b*21 of the outer peripheral face 20*b*2. Note that, in FIG. 9 and FIG. 10, imaginary lines extended from the outer peripheral faces 20*b* are illustrated for ease of understanding the cutout portions 202. In the present embodiment, the cutout portion 202 has a shape penetrating from the bonded face 20*a* to the opposite face of the bonded face 20*a* in a direction of thickness of the actuator substrate 20. In some embodiments, the cutout portion 202 may be formed at a part of the bonded face 20*a* side of the actuator substrate 20.

As illustrated in FIG. 10, a length L11 of the cutout portion 202 in a direction along a peripheral direction of the actuator substrate 20 (a direction along the outer edge 20*b*21 of the outer peripheral face 20*b*2 in FIG. 10) is longer than a length L21 of the recessed portion 201 in the direction along the peripheral direction of the actuator substrate 20.

Such a configuration can reliably locate the bottom face 211 of the recessed portion 201 away from the outer peripheral face 20*b* of the actuator substrate 20.

In the present embodiment, when a non-penetrating portion forming the bottom face 211 of the recessed portion 201 is referred to as a step portion 200, the step portion 200 forming a step face being the bottom face 211 of the outer peripheral face 20*b* is recessed in the in-plane direction of the bonded face 20*a* relative to the outer peripheral face 20*b*1 and the outer peripheral face 20*b*2.

For example, the recessed portion 201 has an inner wall 212 and an inner wall 213 between the bonded face 20*a* and inner edges of the bottom face 211 crossing each other. The bottom face 211 has no wall between the bonded face 20*a* and each of the outer edge 211*a* and the outer edge 211*b*. For such a configuration, the recessed portion 201 is open to the bonded face 20*a* and is also open to the outer peripheral face 20*b*1 and the outer peripheral face 20*b*2.

A wall 216 between an outer peripheral wall 214 forming a bottom face of one of the cutout portions 202 and the outer peripheral face 20*b*1 of the actuator substrate 20 has a curved shape (or may have an inclined shape). Likewise, a wall 217 between an outer peripheral wall 215 forming a bottom face of another of the cutout portions 202 and the outer peripheral face 20*b*2 of the actuator substrate 20 has a curved shape (or may have an inclined shape). In the present embodiment, the outer peripheral wall 214 and the outer peripheral wall 215 fall from the bottom face 211 of the recessed portion 201 to the opposite face of the bonded face 20*a*. In some embodiments, the outer peripheral wall 214 and the outer peripheral wall 215 may not reach the opposite face.

Figure 12:
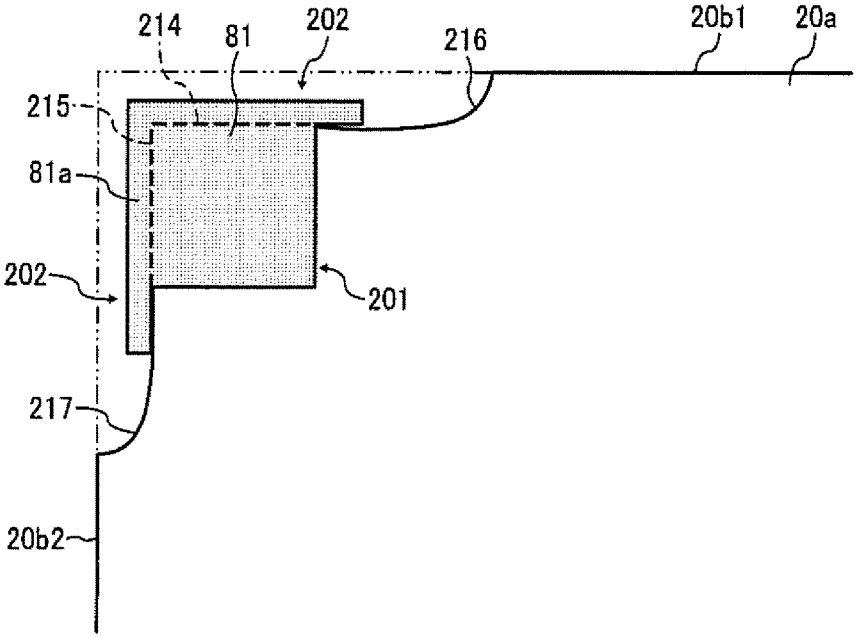
FIG. 12 is a plan view of one corner of the actuator substrate in the first embodiment.

Next, an operation effect of the present embodiment is described with reference to FIG. 12. FIG. 12 is a plan view of one corner of the actuator substrate 20 according to the present embodiment.

When the actuator substrate 20 and the nozzle plate 1 are bonded together with the adhesive 80, the adhesive 80 is coated onto the bonded face 20*a* of the actuator substrate 20 and a temporary bonding adhesive 81, for example, ultraviolet curing adhesive is coated into the recessed portion 201.

Note that, as the adhesive 80, any suitable adhesive may be used in consideration of mechanical strength, liquid contact properties, modulus of elasticity, and adhesiveness to components. The adhesive may be, for example, epoxy resin adhesive, urethane resin adhesive, or elastomer resin adhesive. As a method of coating the adhesive 80, for example, a thin-film printing method, a spray coating method, or a dispensing method may be used.

The actuator substrate 20 and the nozzle plate 1 are positioned and the temporary bonding adhesive 81 are irradiated and cured with ultraviolet rays. Thus, the actuator substrate 20 and the nozzle plate 1 are temporarily bonded together.

At this time, the recessed portion 201 retaining the temporary bonding adhesive 81 is open not only to the bonded face 20*a* of the actuator substrate 20 but also to the outer peripheral face 20*b*1 and the outer peripheral face 20*b*2, thus facilitating the irradiation of ultraviolet rays.

When the temporary bonding adhesive 81 is coated into the recessed portion 201, as illustrated in FIG. 12, an excess adhesive 81*a* extending off the recessed portion 201 in the in-plane direction of the bonded face 20*a* moves along and stops on the outer peripheral wall 214 and the outer peripheral wall 215 and the wall 216 and the wall 217 of the cutout portions 202. In the direction of thickness of the actuator substrate 20 (the direction vertical to the bonded face 20*a*), the excess adhesive 81*a* moves along and stops on the outer peripheral wall 214 and the outer peripheral wall 214 and the outer peripheral wall 215 of the cutout portion 202.

At this time, the outer edge 211*a* and the outer edge 211*b* of the bottom face 211 of the recessed portion 201 are disposed at inner positions in the in-plane direction of the bonded face 20*a* than the outer edge 20*b*11 of the outer peripheral face 20*b*1 and the outer edge 20*b*21 of the outer peripheral face 20*b*2, respectively. Such a configuration can prevent the excess adhesive 81*a* from reaching the outer peripheral face 20*b*1 and the outer peripheral face 20*b*2.

In such a case, the outer peripheral wall 214 and the outer peripheral wall 215 of the cutout portion 202 are continuous with the wall 216 and the wall 217 that have a curved shape. Accordingly, increased surface areas of the wall 216 and the wall 217 can be obtained, thus increasing the amount of adhesive retained on the wall 216 and the wall 217.

Such a configuration can reliably prevent the excess adhesive 81*a* extending off the recessed portions 201 from reaching the outer peripheral face 20*b*1 and the outer peripheral face 20*b*2.

Figure 13:
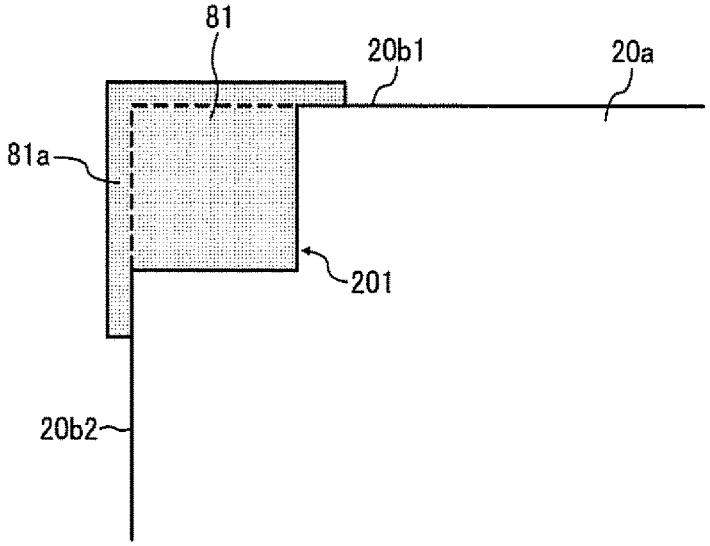
FIG. 13 is a plan view of one corner of a comparative example.

Next, a comparative example is described with reference to FIG. 13. FIG. 13 is a plan view of one corner of the comparative example.

For the comparative example, the outer edge 211*a* and the outer edge 211*b* of the bottom face 211 of the recessed portion 201 are disposed at the same positions as the outer edge 20*b*11 of the outer peripheral face 20*b*1 and the outer edge 20*b*21 of the outer peripheral face 20*b*2, respectively. In other words, the comparative example does not include the cutout portion 202 according to the above-described first embodiment.

Accordingly, when the temporary bonding adhesive 81 is coated into the recessed portion 201, as illustrated in FIG. 13, an excess adhesive 81*a* extending off the recessed portion 201 reaches the outer peripheral face 20*b*1 and the outer peripheral face 20*b*2.

Figure 14:
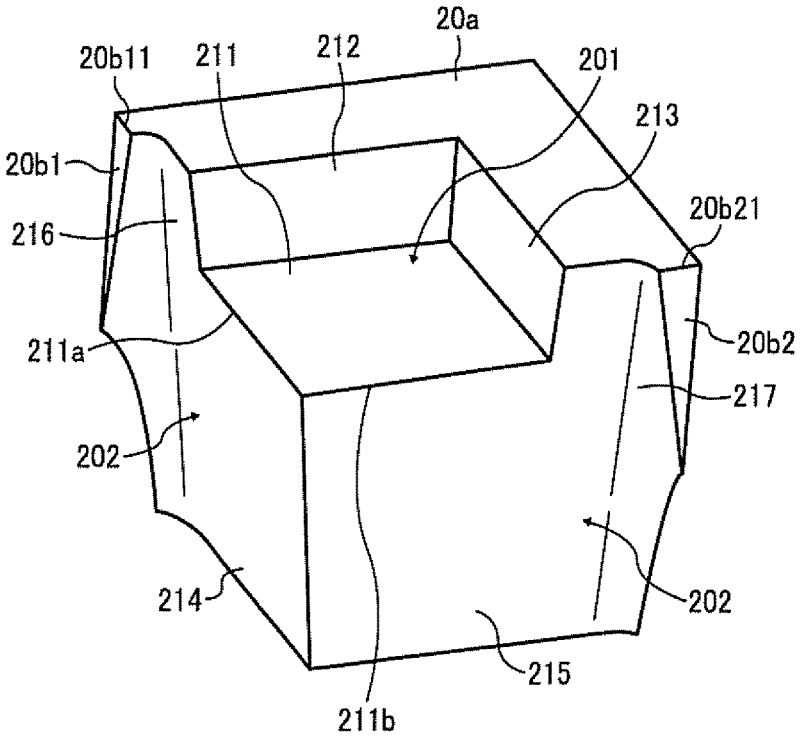
FIG. 14 is a perspective view of a recessed portion in a second embodiment of the present disclosure.
Figure 15:
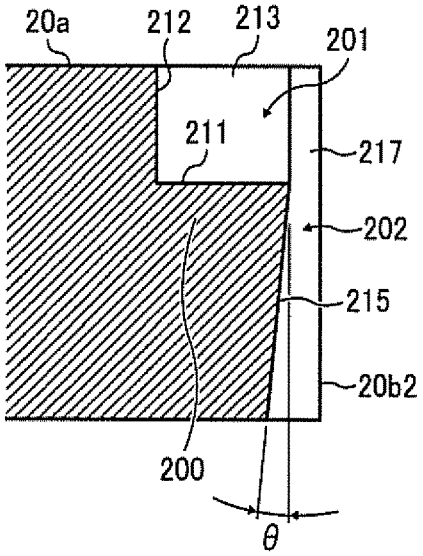
FIG. 15 is a cross-sectional view of the recessed portion in the second embodiment.

Next, a second embodiment of the present disclosure is described with reference to FIGS. 14 and 15. FIG. 14 is a perspective view of the recessed portion 201 in the second embodiment. FIG. 15 is a cross-sectional view of the recessed portion 201 in the second embodiment.

In the present embodiment, each of the outer peripheral wall 214 and the outer peripheral wall 215 of the cutout portions 202 is an inclined face inclined at an angle θ relative to the outer peripheral face 20*b* in the direction vertical to the bonded face 20*a* (the direction of thickness of the bonded face 20*a*). The amount of recess from the outer peripheral face 20*b* is greater as the outer peripheral wall 215 approaches the opposite face of the bonded face 20*a* in the direction of thickness. In the present embodiment, the outer peripheral wall 214 and the outer peripheral wall 215 are entirely inclined faces. Note that, in some embodiments, each of the outer peripheral wall 214 and the outer peripheral wall 215 may have a partially inclined or curved portion.

Such a configuration can obtain increased surface areas of the outer peripheral wall 214 and the outer peripheral wall 215 of the cutout portion 202, thus increasing the amount of adhesive retained on the outer peripheral wall 214 and the outer peripheral wall 215.

Such a configuration can reliably prevent the excess adhesive 81*a* extending off the recessed portions 201 from reaching the outer peripheral face 20*b*1 and the outer peripheral face 20*b*2.

Figure 16:
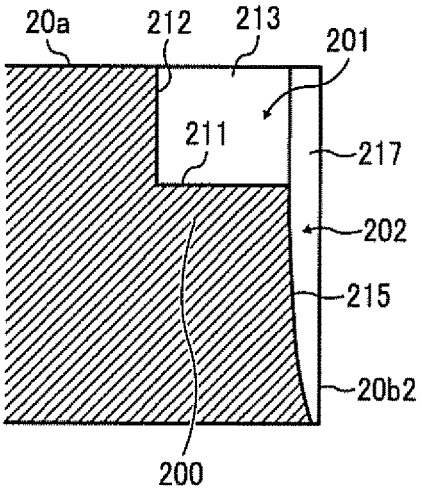
FIG. 16 is a cross-sectional view of a recessed portion in a third embodiment of the present disclosure.

Next, a third embodiment of the present disclosure is described with reference to FIG. 16. FIG. 16 is a cross-sectional view of the recessed portion in the third embodiment.

In the present embodiment, the outer peripheral wall 215 (or the outer peripheral wall 214) of the cutout portion 202 is a curved face (or an inclined face) that varies in the amount of recess from the outer peripheral face 20*b*2. In contrast with the second embodiment, the amount of recess from the outer peripheral face 20*b*2 is greater as the outer peripheral wall 215 approaches the opposite face of the bonded face 20*a* in the direction of thickness. In the present embodiment, the outer peripheral wall 215 is entirely an inclined face. Note that, in some embodiments, the outer peripheral wall 215 may have a partially inclined or curved portion.

Figure 17:
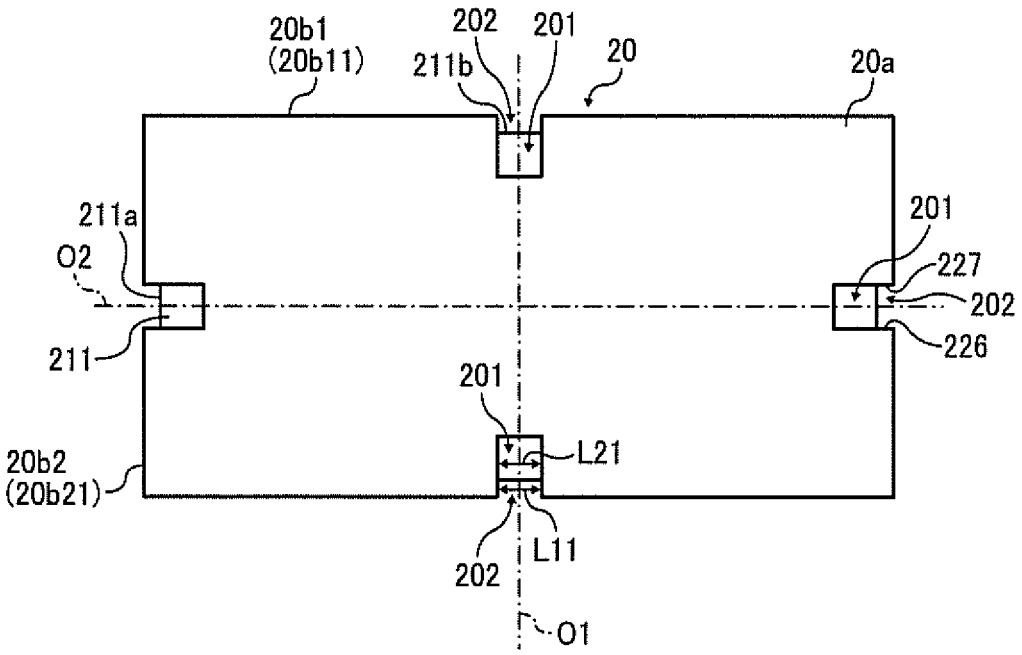
FIG. 17 is a plan view of a bonded face side of the actuator substrate to be bonded to the nozzle plate in a fourth embodiment of the present disclosure.
Figure 18:
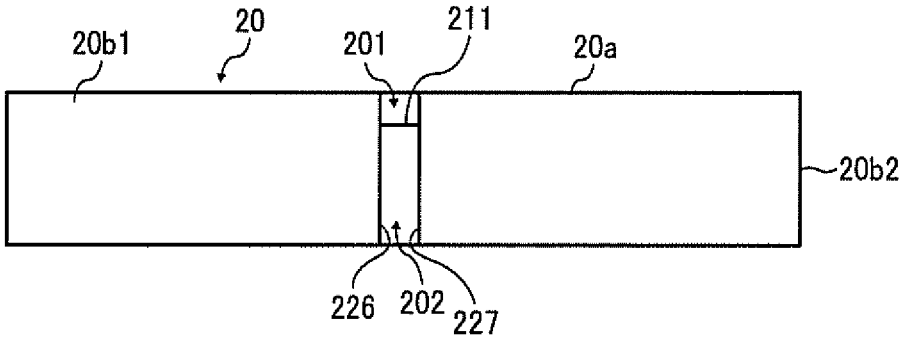
FIG. 18 is a side view of a long side of the actuator substrate in the fourth embodiment.
Figure 19:
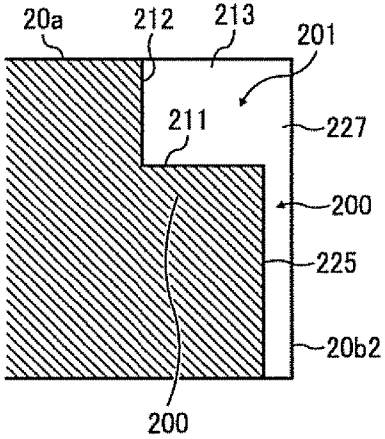
FIG. 19 is a cross-sectional view of the recessed portion of the actuator substrate in the fourth embodiment.

Next, a fourth embodiment of the present disclosure is described with reference to FIGS. 17 to 19. FIG. 17 is a plan view of a bonded face side of the actuator substrate to be bonded to the nozzle plate. FIG. 18 is a side view of a long side of the actuator substrate. FIG. 19 is a cross-sectional view of the recessed portion of the actuator substrate.

For the present embodiment, the recessed portion 201 and the cutout portion 202 are disposed midway of each side of the actuator substrate 20 of a rectangular shape. In the present embodiment, the recessed portion 201 and the cutout portion 202 are disposed on the center line O1 or the center line O2 of the bonded face 20*a*. The third embodiment differs from the first embodiment and the second embodiment in that the recessed portion 201 is open to the outer peripheral face 20*b* at only one side and surrounded at three sides.

The length L11 of the cutout portion 202 in the direction along a peripheral direction of the actuator substrate 20 is longer than the length L21 of the recessed portion 201 the direction along a peripheral direction of the actuator substrate 20.

Accordingly, a wall 226 and a wall 227 connecting an outer peripheral wall 225, which is a bottom face of the cutout portion 202, with the outer peripheral face 20*b*1 and the outer peripheral face 20*b*2 are substantially vertical to the outer peripheral face 20*b*1 and the outer peripheral face 20*b*2. In the present embodiment, the outer peripheral wall 225 falls from the bottom face 211 of the recessed portion 201 to the opposite face of the bonded face 20*a*. In some embodiments, the outer peripheral wall 225 may not reach the opposite face.

With such a configuration, the outer edge 211*a* and the outer edge 211*b* of the bottom face 211 of the recessed portion 201 are disposed at inner positions in the in-plane direction of the bonded face 20*a* than the outer edge 20*b*21 of the outer peripheral face 20*b*2 and the outer edge 20*b*11 of the outer peripheral face 20*b*1, respectively. Such a configuration can retain an excess adhesive extending off the recessed portion 201 with the outer peripheral wall 225 and the wall 226 and the wall 227, thus preventing the excess adhesive from reaching the outer peripheral face 20*b*1 and the outer peripheral face 20*b*2.

Figure 20B:
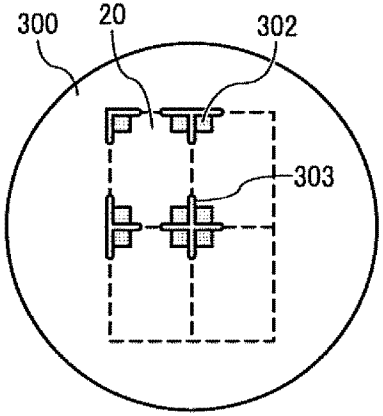
FIGS. 20A through 20C are plan views of an example of a production process of the actuator substrate according to the first embodiment.
Figure 20C:
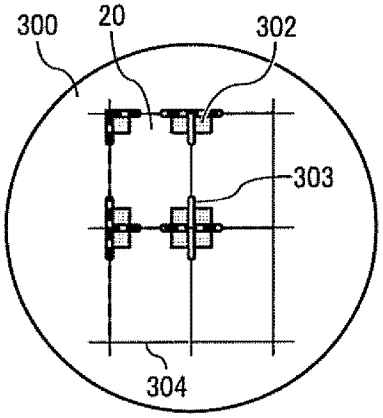
Figure 20A:
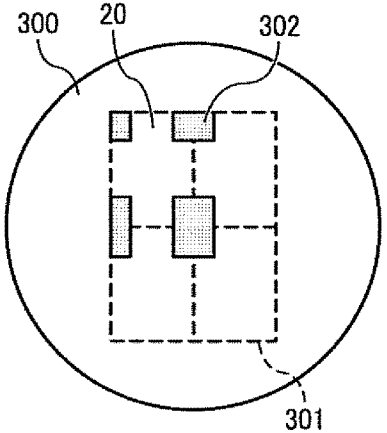
Figure 21A:
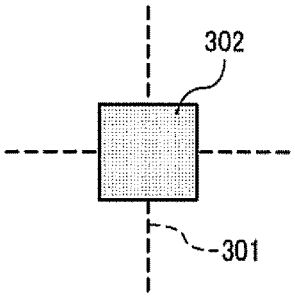
FIGS. 21A through 21C are enlarged plan views of step portions in the production process.
Figure 21B:
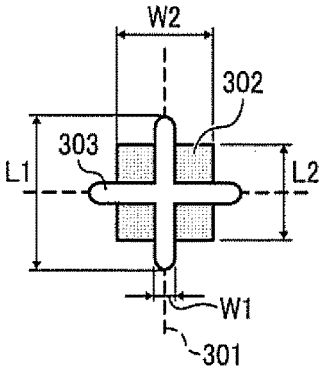
Figure 21C:
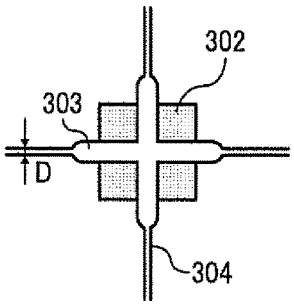

Next, an example of a process of producing the actuator substrate according to the above-described first embodiment is described with reference to FIGS. 20A through 20C and FIGS. 21A through 21C. FIGS. 20A through 20C are plan views of the actuator substrate according to the above-described first embodiment in the production process. FIGS. 21A through 21C are enlarged plan views of step portions in the production process.

In the present embodiment, as illustrated in FIG. 20A, for example, a plurality of actuator substrates 20 is formed on a silicon wafer 300. The silicon wafer 300 are cut along scheduled cutting lines 301 and divided into individual pieces of the actuator substrates 20 (chips).

As illustrated in FIGS. 20A and 21B, non-penetrating recessed portions 302, which are to be the recessed portions 201 after dicing, are formed by etching crossing portions of the scheduled cutting lines 301, which are to be four corners of the separate actuator substrates 20 after dicing. The non-penetrating recessed portions 302 do not penetrate through the wafer 300.

As illustrated in FIGS. 20B and 21B, slits 303, which are to be the cutout portions 202 after dicing, are formed by etching the crossing portions of the scheduled cutting lines 301 and the non-penetrating recessed portions 302. The slits 303 penetrate through the wafer 300.

Note that the slits 303 are preferably formed by, for example, wet etching. Surface roughening by wet etching can enhance the bonding force of adhesive with the wall by anchor effect when the adhesive extends off the recessed portion 201, thus reducing dropping of the adhesive.

As illustrated in FIGS. 20C and 21C, dicing is performed along the scheduled cutting lines 301 and cutting process is performed as indicated by processing lines (dicing lines) 304.

Stress is applied to the wafer 300 by, e.g., expanding, thus dividing the wafer 300 into the individual pieces of the actuator substrates 20 (chips).

Dicing is performed by, for example, a method of cutting the wafer 300 with a rotary edge (blade) or a method of cutting the wafer 300 by melting or vaporizing cutting portions with thermal energy of laser light. For the method of cutting the wafer 300 with the blade, the blade is used that has a smaller width than the width of the slit 303. Alternatively, for the method of cutting the wafer 300 with the laser light, the spot diameter of laser light is set to be smaller than the width of the slit 303.

Stealth dicing is preferably used. In comparison with blade dicing setting a cutting margin corresponding to the width of the blade, stealth dicing can divide the wafer 300 into the individual pieces of the actuator substrates 20 (chips) without such a cutting margin. Accordingly, the non-penetrating recessed portion 302, which is to be the recessed portion 201, can be disposed at inner positions than the outer peripheral face of the chip (the actuator substrate 20).

Stealth dicing is a laser processing method of dividing a plate-shaped workpiece, such as a wafer, with pulse laser light having transparency relative to the workpiece by emitting the pulse laser light with a focal point set on the inside of a target area to be divided.

For the dividing method using the laser processing method, the pulse laser light of a wavelength (e.g., 1064 nm) having transparency relative to the workpiece is emitted with the focal point set on the inside of the workpiece from one face of the workpiece, to form continuously form an altered layer along a street inside the workpiece. The workpiece is divided by applying an external force along the street, which has a decreased strength due to the formation of the altered layer.

Figure 22:
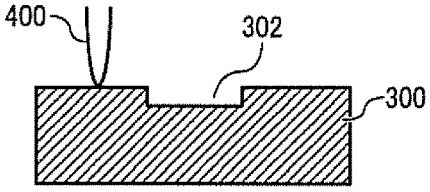
FIG. 22 is an illustration of laser processing.

For the processing with the laser processing method, as illustrated in FIG. 22, when the non-penetrating recessed portion 302 is formed in a scanning area of laser light 400 to form a step portion, the focal point is different between the surface of the wafer 300 and the bottom face of the non-penetrating recessed portion 302, thus causing a reduced processing accuracy and a processing failure. In such a case, the focal point can be adjusted with a reduced productivity.

Figure 23:
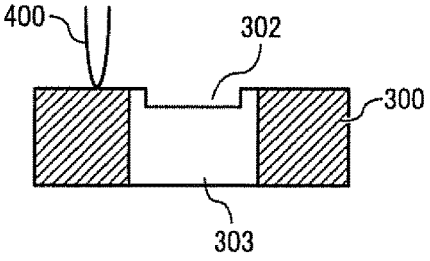
FIG. 23 is an illustration of laser processing.

Hence, as described above, a step structure portion formed by the non-penetrating recessed portion 302 is processed by, e.g., etching to preliminarily form the slit 303 penetrating through the wafer 300 as illustrated in FIG. 23.

Accordingly, the step structure portion is eliminated in the scanning area of the laser light, thus allowing the wafer 300 to be processed at high productivity and high accuracy without changing a laser property (the focal point) at the recessed portion.

In such a case, as illustrated in FIGS. 21A through 21C, the length L1 of the slit 303 in the longitudinal direction of the slit 303 is longer than the length L2 of the non-penetrating recessed portion 302 in the same direction as the longitudinal direction of the slit 303.

Such a configuration can reliably dispose the recessed portion 201 away from the outer peripheral face 20*b*1 and the outer peripheral face 20*b*2 as described above, thus more reliably preventing the adhesive extending off the recessed portion 201 from spreading over the outer peripheral face 20*b*1 and the outer peripheral face 20*b*2.

The length W1 of the slit 303 in a transverse direction of the slit 303 is shorter than the width W2 of the non-penetrating recessed portion 302 in a transverse direction of the non-penetrating recessed portion 302 and longer than the spot diameter of laser light (corresponding to the width D illustrated in FIG. 21C). Such a configuration prevents laser light from scanning the non-penetrating recessed portions 302.

In the above-described embodiments, the recessed portions and the cutout portions are formed in the actuator substrates (the channel substrate or the channel plate) in the liquid discharge head. In some embodiments, the recessed portions and the cutout portions may be formed in, for example, the nozzle plate.

The bonded member is not limited to the bonded member of the actuator substrate and the nozzle plate. In some embodiments, the bonded member may be a bonded member of the actuator substrate and the holding substrate or a bonded member of the holding substrate and one of the common-liquid-chamber substrate and the frame substrate.

Alternatively, for example, the bonded member may be a bonded member of two members of a device other than the liquid discharge head.

Figure 24:
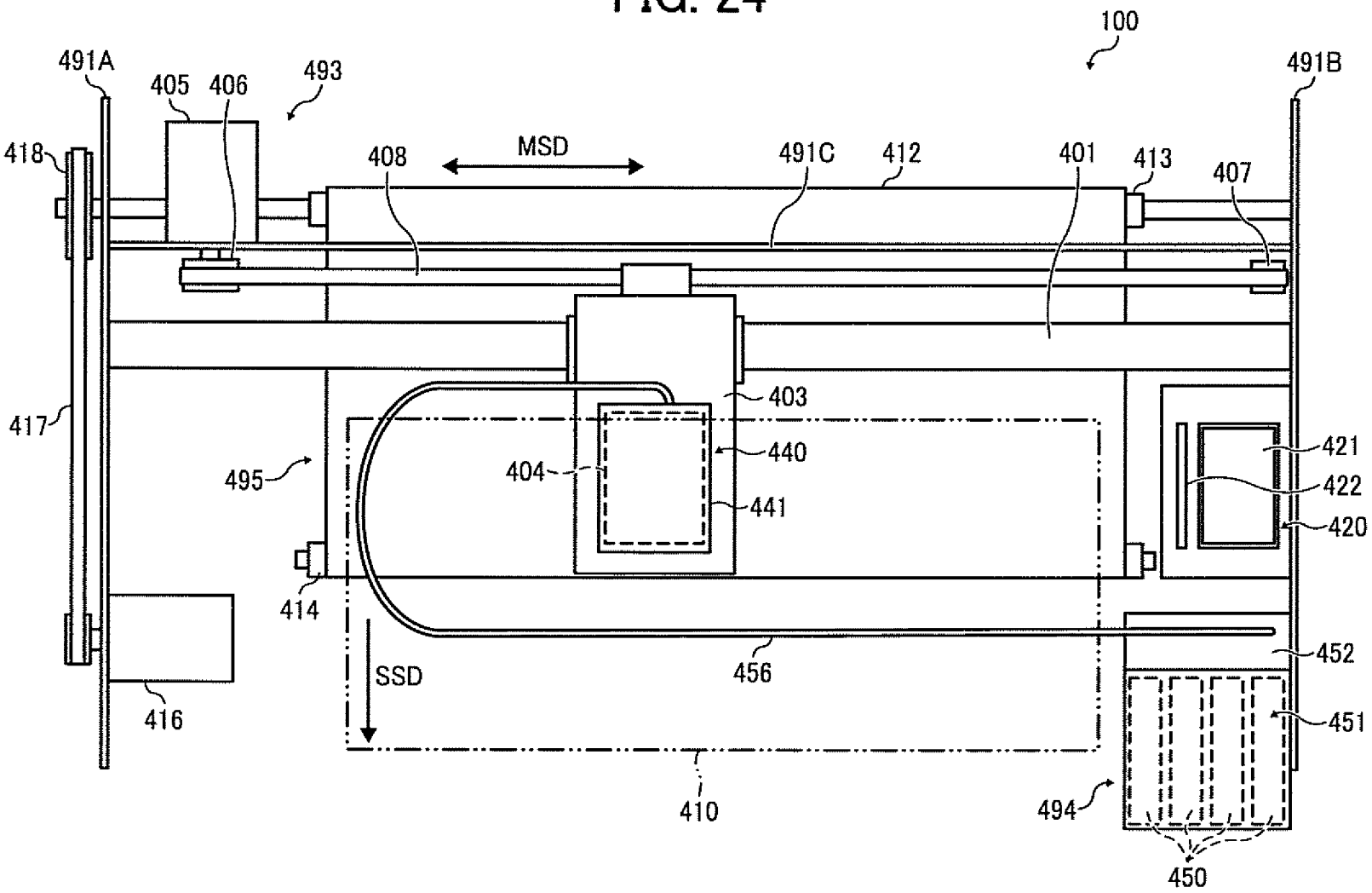
FIG. 24 is a plan view of a portion of a liquid discharge apparatus according to an embodiment of the present disclosure.
Figure 25:
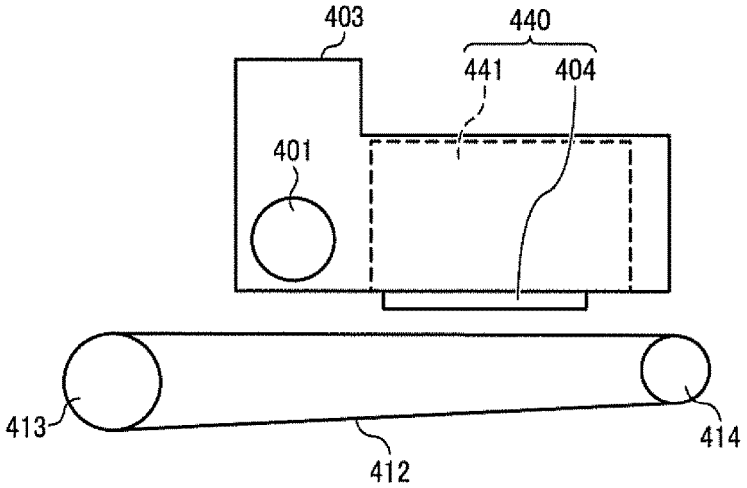
FIG. 25 is a side view of a portion of the liquid discharge apparatus of FIG. 24 including a liquid discharge device.

Next, an example of a liquid discharge apparatus according to an embodiment of the present disclosure is described with reference to FIGS. 24 and 25. FIG. 24 is a plan view of a portion of the liquid discharge apparatus according to an embodiment of the present disclosure. FIG. 25 is a side view of a portion of the liquid discharge apparatus.

A liquid discharge apparatus 100 according to the present embodiment is a serial-type apparatus in which a main scan moving unit 493 reciprocally moves a carriage 403 in a main scanning direction indicated by arrow MSD in FIG. 24. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 24, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump. The liquid cartridges 450 are detachably mounted to the cartridge holder 451. The liquid is supplied to the head tank 441 by the liquid feed unit 452 via the tube 456 from the liquid cartridges 450.

The liquid discharge apparatus 100 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 100 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 100 includes the liquid discharge head 404 according to an embodiment of the present disclosure, thus allowing stable formation of high quality images.

Figure 26:
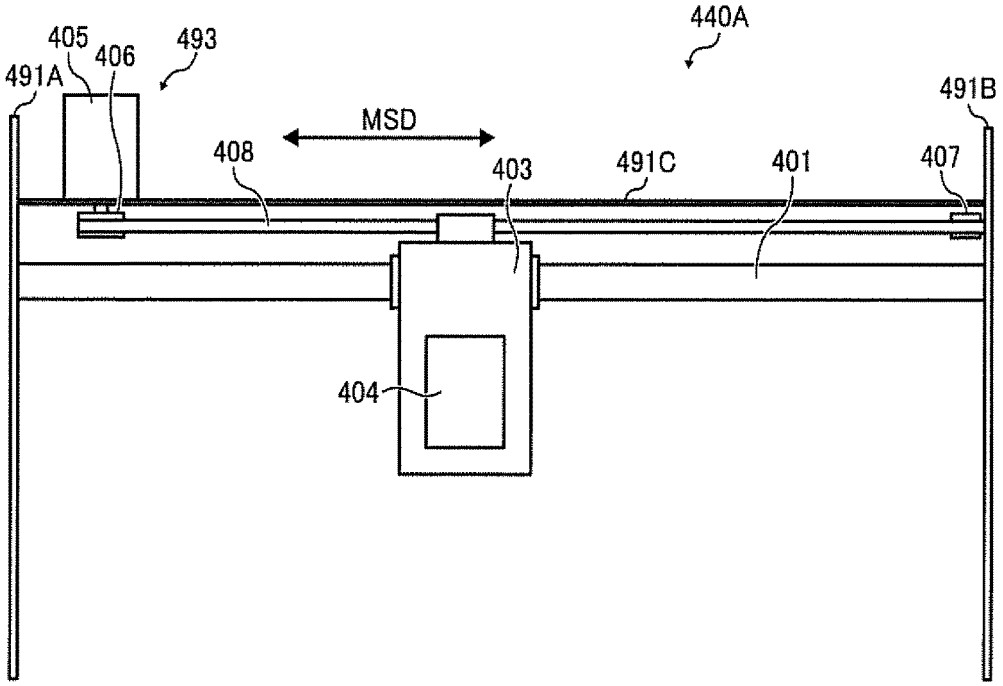
FIG. 26 is a plan view of a portion of another example of the liquid discharge device.

Next, another example of the liquid discharge device according to an embodiment of the present disclosure is described with reference to FIG. 26. FIG. 26 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 100. The left side plate 491A, the right side plate 491B, and the rear side plate 491C form the housing.

Note that, in the liquid discharge device 440A, at least one of the maintenance unit 420 and the supply unit 494 may be mounted on, for example, the right side plate 491B.

Figure 27:
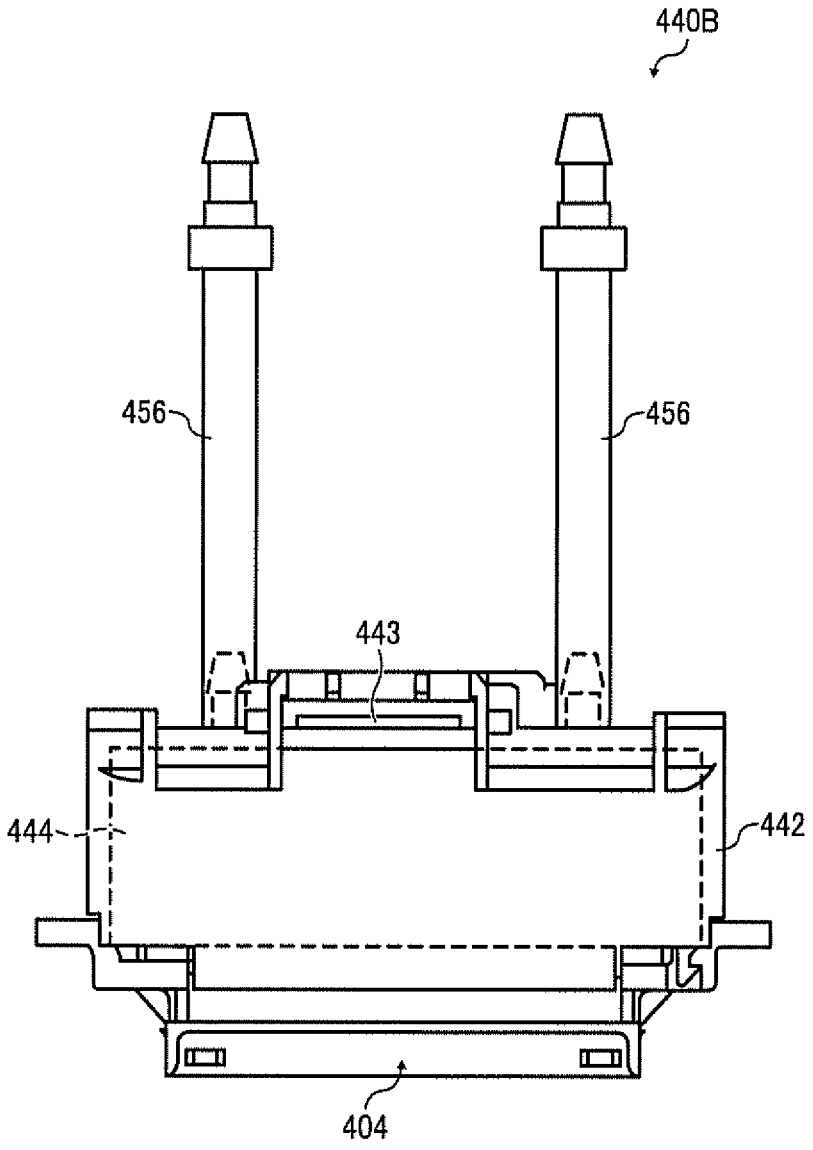
FIG. 27 is a front view of still another example of the liquid discharge device.

Next, still another example of the liquid discharge device according to an embodiment of the present disclosure is described with reference to FIG. 27. FIG. 27 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to discharge liquid to form an image on a medium or a solid fabricating apparatus (three-dimensional fabricating apparatus) to discharge a fabrication liquid to a powder layer in which powder is formed in layers to form a solid fabricating object (three-dimensional object).

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described material to which liquid can adhere may include any material to which liquid may adhere even temporarily. The material to which liquid can adhere may be, e.g., paper, thread, fiber, fabric, leather, metal, plastics, glass, wood, and ceramics, to which liquid can adhere even temporarily.

The liquid may be, e.g., ink, treatment liquid, DNA sample, resist, pattern material, binder, and mold liquid.

The liquid discharge apparatus may be, unless in particular limited, any of a serial-type apparatus to move the liquid discharge head and a line-type apparatus not to move the liquid discharge head.

The liquid discharge apparatus may be, for example, a treatment liquid coating apparatus to discharge a treatment liquid to a sheet to coat the treatment liquid on the surface of the sheet to reform the sheet surface or an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

For example, like the liquid discharge device 440 illustrated in FIG. 25, the liquid discharge device may be the integrated unit in which the liquid discharge head and the head tank are integrated. The liquid discharge head and the head tank may be connected each other via, e.g., a tube to form the liquid discharge device as the integrated unit. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may include the liquid discharge head movably held by the guide that forms part of the main scan moving unit, so that the liquid discharge head and the main scan moving unit are integrated as a single unit. Like the liquid discharge device 440A illustrated in FIG. 26, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 27, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A bonded member comprising:

at least two members including a first member and a second member bonded to each other, the first member having a bonded face bonded to the second member, the bonded face having one or more recessed portions at an outer periphery of the bonded face, to retain an adhesive, each recessed portion amongst the one or more recessed portions being open at the bonded face and an outer peripheral face of the first member; and a cutout portion at the outer peripheral face of the first member, to recede an outer edge of a bottom face of the recessed portion inwardly in an in-plane direction of the bonded face from an outer edge of the outer peripheral face of the first member.

2. The bonded member according to claim 1, wherein in a plan view from a direction vertical to the bonded face, the outer edge of the bottom face of the recessed portion is disposed at an inner position in the in-plane direction of the bonded face, relative to the outer edge of the outer peripheral face of the first member.

3. The bonded member according to claim 1, wherein the recessed portion is disposed at a corner of the first member in a plan view from a direction vertical to the bonded face, and wherein the recessed portion is continuously open in two directions at the outer peripheral face.

4. The bonded member according to claim 1, wherein the recessed portions include plural recessed portions disposed at line-symmetric positions with respect to a center line of the bonded face.

5. The bonded member according to claim 1, wherein a length of the cutout portion in a peripheral direction of the first member is longer than a length of the recessed portion in the peripheral direction.

6. The bonded member according to claim 1, wherein a length of the cutout portion in a peripheral direction of the first member is equal to a length of the recessed portion in the peripheral direction.

7. The bonded member according to claim 1, wherein a wall of the recessed portion has an entirely inclined or curved shape or partially includes an inclined or curved portion in a peripheral direction of the first member.

8. The bonded member according to claim 1, wherein a wall of the recessed portion has an entirely inclined or curved shape or partially includes an inclined or curved portion in a direction of thickness of the first member.

9. A liquid discharge head comprising the bonded member according to claim 1.

10. The liquid discharge head according to claim 9, wherein the at least two members of the bonded member include:

a nozzle plate including nozzles to discharge liquid; and a channel substrate including a plurality of individual liquid chambers communicated with the nozzles.

11. The liquid discharge head according to claim 9, wherein the at least two members of the bonded member include:

a channel substrate including a plurality of individual liquid chambers communicated with nozzles to discharge liquid; and a holding substrate to accommodate a plurality of pressure generators to pressurize liquid in the plurality of individual liquid chambers.

12. The liquid discharge head according to claim 9, wherein the at least two members of the bonded member include:

a holding substrate to accommodate a plurality of pressure generators to pressurize liquid in a plurality of individual liquid chambers communicated with nozzles to discharge liquid; and a common liquid chamber substrate including a common liquid chamber to supply the plurality of individual liquid chambers.

13. A liquid discharge device comprising the liquid discharge head according to claim 9 to discharge liquid.

14. A liquid discharge apparatus comprising the liquid discharge head according to claim 9.

15. The liquid discharge device according to claim 13, wherein the liquid discharge head is integrated as a single unit with at least one of:

a head tank to store liquid to be supplied to the liquid discharge head;

a carriage mounting the liquid discharge head;

a supply unit to supply liquid to the liquid discharge head;

a maintenance unit to maintain the liquid discharge head; and a main scan moving unit to move the liquid discharge head in a main scanning direction.

16. A liquid discharge apparatus comprising the liquid discharge device according to claim 13.

* * * * *